US006897754B2

(12) United States Patent
Jeong et al.

(10) Patent No.: US 6,897,754 B2
(45) Date of Patent: May 24, 2005

(54) MAGNETIC CORE FOR INDUCTOR

(75) Inventors: Bong Soo Jeong, Incheon (KR); Michio Ishikawa, Yokohama (JP); Jin Wook Koo, Seoul (KR)

(73) Assignees: Pulsus Technologies Inc., Kyungsangbuk-do (KR); Korea Coil Engineering Co. Ltd., Seoul (KR)

( * ) Notice: Subject to any disclaimer, the term of this patent is extended or adjusted under 35 U.S.C. 154(b) by 0 days.

(21) Appl. No.: 10/163,887

(22) Filed: Jun. 5, 2002

(65) Prior Publication Data

US 2003/0020580 A1 Jan. 30, 2003

(30) Foreign Application Priority Data

Jul. 25, 2001 (KR) ..... 2001-44822
Mar. 22, 2002 (KR) ..... 2002-15573

(51) Int. Cl.[7] ..... H01F 27/02
(52) U.S. Cl. ..... 336/83; 336/178; 336/200
(58) Field of Search ..... 336/65, 83, 178, 336/198, 200, 210–212, 216, 221, 233, 234

(56) References Cited

U.S. PATENT DOCUMENTS 3,197,167 A * 7/1965 Sturgis ..... 248/314
3,371,301 A * 2/1968 Takao ..... 336/83
3,584,823 A * 6/1971 Andrew et al. ..... 248/164
5,489,884 A * 2/1996 Heringer et al. ..... 336/210
6,501,362 B1 * 12/2002 Hoffman et al. ..... 336/198

* cited by examiner

*Primary Examiner*—Tuyen T. Nguyen
(74) *Attorney, Agent, or Firm*—Volpe and Koenig, P.C.

(57) ABSTRACT

Disclosed is a low-priced and small-sized magnetic core for an inductor suitable for a high frequency signal and a large-current signal. The magnetic core is modified from a conventional EP type magnetic core. A recess is integrally formed with a peripheral portion of the magnetic core when it is shaped. A bottom portion and the peripheral portion are extended toward an opening portion to an extent of about 70 percentages of a length measured from a center of the center portion to an internal surface of the peripheral portion. The peripheral portion opposite to the opening portion has a uniform thickness. The magnetic core is designed to facilitate its surface mounting onto a PCB.

13 Claims, 10 Drawing Sheets

Prior Art

Prior Art

Prior Art

Prior Art

MAGNETIC CORE FOR INDUCTOR

BACKGROUND OF THE INVENTION

1. Field of the Invention

The present invention relates to a magnetic core for an inductor, and more particularly, to a small-sized and low-priced magnetic core for an inductor suitable for a high-frequency signal and a large-current signal. Also, the present invention relates to a structure of a magnetic core for an inductor used in a digital audio amplifier or D-class audio amplifier.

2. Description of the Related Art

Recently, with the digitalizing progress of an electronic record signal and control signal, the digitalization of an amplifier is progressed in an audio appliance. In amplifying a digital signal of CD, MD and DVD, the digital signal has to be converted to an analog signal prior to its amplification. In this process, there are some problems in that a sound quality inferior becomes due to waveform variation caused by deterioration of a high-band signal and lack of the dynamic response characteristic, and heat is generated due to a low-efficiency amplification. In the latest digital amplifier technique, logic circuits having a good performance of converting a pulse code modulation (PCM) signal to a pulse width modulation (PWM) signal are implemented, and a high-speed and high-accuracy switching of a large-power digital signal becomes possible, thereby completely amplifying sound in a digital state. In order to be able to listen to such an amplified signal, a high-frequency carrier signal has to be removed from the amplified signal to prevent the signal from being outputted through a loudspeaker. To this end, a low pass filter having an inductor is provided in an end terminal of the amplifier.

As described above, since the signal of the digital audio amplifier is a high-frequency signal and a large-current signal, a magnetic core to be used in the digital audio amplifier should have a good saturation characteristic, and is to be constructed to shield magnetic flux due to the large-current variation not to influence peripheral circuits. Comparing to the conventional analog audio amplifier, the digital audio amplifier has a low share in a market of audio amplifier. In order to increase the market share of the digital audio amplifier, a technique of manufacturing a low-priced amplifier is required. Recently, the miniaturization of goods in household electric appliances is also an indispensable condition. Accordingly, the magnetic core in the inductor used in the digital audio amplifier has to be low-priced, a small-sized, and suitable for the large-current signal and the high-frequency signal.

The conventional magnetic core for the inductor used in the digital audio amplifier will now be described with reference to FIGS. 1A through 1C, and FIG. 2.

FIG. 1A is a perspective view of an inductor having a DR type magnetic core. FIGS. 1B and 1C are a front view of an inductor having a DR-plus-Ring type magnetic core and a perspective view of a cylindrical shield, respectively. The DR type magnetic core and the DR-plus-Ring type magnetic core are used in a power inductor suitable for a signal having a large amount of current. Since the magnetic cores are inexpensive, they are used in the digital audio amplifier. However, since the DR type magnetic core has no member for shielding the generated magnetic flux, there is a problem of completely leaking the magnetic flux. In order to solve the above problem, the DR-plus-Ring type magnetic core has been proposed. As shown in FIG. 1B, the DR-plus-Ring type magnetic core includes a cylindrical shield and the DR type magnetic core. The cylindrical shield is shown in FIG. 1C. Since the DR-plus-Ring type magnetic core is not suitable for the high frequency characteristic, like the DR type magnetic core, there is a problem that a filtered waveform has an insufficient fidelity.

The inductor having an aircore coil will now be described with reference to FIG. 2. Since the inductor does not include the magnetic core and thus is not made of magnetic material, there is little distortion of a signal waveform caused by the high-frequency characteristic of the magnetic material. Therefore, the above inductor is greatly used for the digital audio amplifier. However, since the above inductor has the increased number of windings, a capacity component and a direct current resistance component, which are generated between the windings, are increased. In addition, there are some problems that the magnetic flux is completely leaked, and since the inductor is large-sized, it is difficult to surface-mount it onto a small appliance.

That is, the conventional magnetic cores for an inductor used in the digital audio amplifier are not suitable for the large-current signal and the high-frequency signal, in addition to the problem of surface mounting.

A typical process of manufacturing a magnetic core will now be described with reference to FIG. 3. The magnetic core is made of magnetic powder. At first, the magnetic powder is manufactured through the steps of weighting, mixing, calcining, milling and spray-drying (not shown). The magnetic powder manufactured by the above process is introduced into a mold having a desired shape of magnetic core, is pressed (step 301), and is sintered (step 303) so that the magnetic core is formed. Since the magnetic core formed at the above steps has a coarse surface, an outer surface of the magnetic core is processed through a primary grinding (step 303). The primary grinding grinds the entire surface of the magnetic core, so that the coarse surface formed through the steps 301 and 302 is uniformly ground. After that, in order to form an air gap in the magnetic core, a secondary grinding is performed to grind a center portion of the magnetic core to a predetermined depth (step 304). As the secondary grinding determines a magnetic characteristic of an inductor, it requires the precision. In order to secondarily grind a plurality of magnetic cores, the step of approaching a grinder to the center portion of the magnetic core has to be performed on every magnetic core prior to the secondary grinding. Then, the grinding is performed by repeating the approaching and separating processes, with a grinding depth of the grinder being adjusted. Therefore, it is impossible to secondarily grind the plurality of magnetic cores without the approaching and the separating processes, and thus the manufacturing cost is increased.

In addition, since the magnetic powder constituting the magnetic core is relatively expensive, the purchasing cost of the magnetic powder forms a major portion of the manufacturing cost of the magnetic core. Accordingly, in order to reduce the manufacturing cost of the magnetic core for an inductor suitable for a small-sized digital audio amplifier, it is necessary to manufacture a magnetic core using a small amount of magnetic powder.

SUMMARY OF THE INVENTION

Accordingly, the present invention is directed to a magnetic core for an inductor that substantially obviates one or more problems due to limitations and disadvantages of the related art.

It is an object of the present invention to provide a magnetic core for an inductor suitable for a digital audio amplifier.

The present invention provides an improved EP type magnetic core that is rarely used in the digital audio amplifier. The EP type magnetic core is a kind of trademark of a magnetic core for an inductor that is presently available from TDK Corporation or other companies, and is widely known in the art. A modified EP type magnetic core according to the present invention is referred to as an EPS type magnetic core.

Another object of the present invention is to provide a magnetic core suitable for a large-current signal and a high-frequency signal.

Still another object of the present invention is to provide a magnetic core capable of shielding leaked magnetic flux generated from a large-current signal and a high-frequency signal.

Still another object of the present invention is to provide a low-priced and small-sized magnetic core for an inductor whose grinding operation is effectively performed to form an air gap and which can be made of a small amount of magnetic powder.

To achieve these objects and other advantages in accordance with the purpose of the invention, as embodied and broadly described herein, there is provided an EPS type magnetic core for an inductor, comprising a center portion, a peripheral portion, a bottom portion, and an opening portion, wherein the bottom portion and the peripheral portion are extended toward the opening portion to an extent of about 70 percentages of a length measured from a center of the center portion to an internal surface of the peripheral portion.

The peripheral portion opposite to the opening portion has a uniform thickness. The thickness of the peripheral portion is constant all over, the peripheral portion being extended toward the opening portion is in a straight line in parallel to each other, and the peripheral portion opposite to the opening portion has a semicircular shape. In case of the semicircular peripheral portion of the EPS type magnetic core, the peripheral portion directly opposite to the opening portion has a flat surface formed on an outer circumference thereof.

The EPS type magnetic core further comprises a recess at a predetermined position of the peripheral portion, the position at which the recess is located is opposite to the opening portion, and the recess has a width larger than or equal to that of the center portion, and a depth more than that of the center portion being ground. The recess is integrally formed with the center portion, the bottom portion, and the peripheral portion.

The EPS type magnetic core is used for a digital audio amplifier suitable for a large-current signal and a high-frequency signal. The magnetic core of the present invention may be distributed in a state that the center portion is secondarily ground or not.

In addition, according to another aspect of the present invention, there is provided an inductor comprising two EPS type magnetic cores being coupled by a bobbin holding a coil.

In another aspect of the present invention, there is provided a magnetic core for an inductor having a center portion, a peripheral portion, and a bottom portion, two magnetic cores being opposite and coupled to each other to form one inductor. Specifically, the center portion of the magnetic core is ground to a predetermined depth to form an air gap, is surrounded with a coil of a bobbin when forming the inductor, and forms a magnetic path through which magnetic flux generated during operation of the inductor flows. The peripheral portion surrounding the center portion, and the bottom portion that couples the center portion to the peripheral portion forms the magnetic path in order to shield the magnetic flux. The coil of the bobbin is inserted into a space defined by the center portion, peripheral portion and the bottom portion.

The magnetic core of the present invention is characterized in that at least one recess is located in the peripheral portion having a width large than or equal to the diameter of the center portion and a depth larger than that of the center portion being ground to facilitate grinding of the center portion, and is integrally formed with the center portion, bottom portion and peripheral portion.

The magnetic core of the present invention is characterized in that at least one recess is located in the peripheral portion opposite to the opening portion having a width larger than or equal to that of the center portion and a depth larger than that of the center portion being ground to facilitate grinding of the center portion, and the recess is integrally formed with the center portion, bottom portion and peripheral portion.

In still another aspect of the present invention, there is provided a method of grinding a center portion of a plurality of magnetic cores for an inductor according to any one of claims 10 to 12, to form an air gap of the inductor, the method comprising the steps of; aligning the plurality of magnetic cores in a line linking a recess and the center portion as a base line; and a grinder continuously grinding the center portion as penetrating through the recess of the magnetic cores.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIGS. 4A to 4C show the construction of a conventional EP type magnetic core 400, in which FIG. 4A is a top plan view, FIG. 4B is a front view, and FIG. 4C is a rear view.

DETAILED DESCRIPTION OF THE PREFERRED EMBODIMENT

Reference will now be made in detail to the preferred embodiment of the present invention, and an example of the preferred embodiment is illustrated in the accompanying drawings.

Figure 1A:
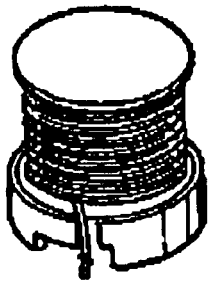
FIG. 1A is a perspective view of an inductor having a DR type magnetic core.
Figure 1B:
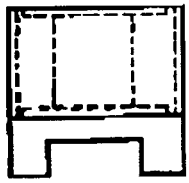
Prior Art FIG. 1B
FIGS. 1B and 1C are a front view of an inductor having a DR-plus-Ring type magnetic core and a perspective view of a cylindrical shield, respectively.
Figure 1C:
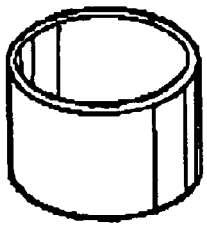
Prior Art FIG. 1C
Figure 2:
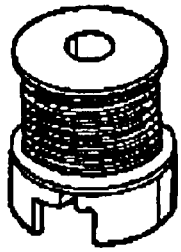
FIG. 2 is a perspective view of an inductor having a conventional aircore coil.
Figure 3:
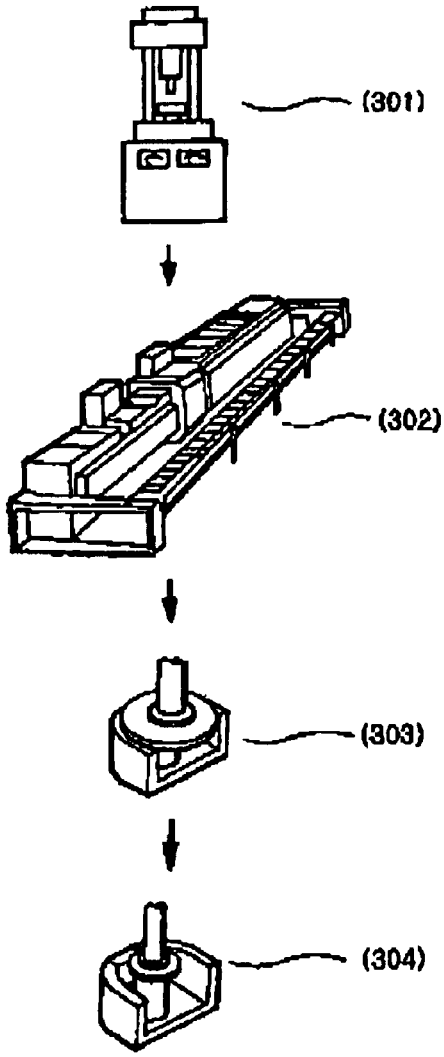
Prior Art FIG. 3
FIG. 3 shows a typical process of manufacturing a magnetic core.
Figure 4A:
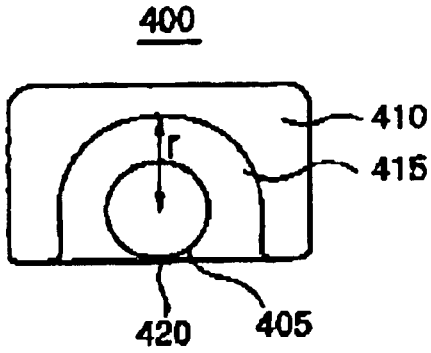
Figure 4B:
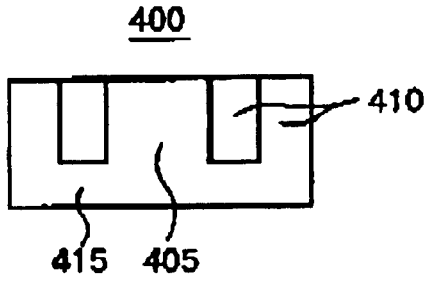
Prior Art FIG. 4B
Figure 4C:
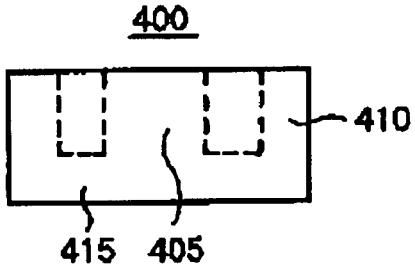
Prior Art FIG. 4C
Figure 4D:
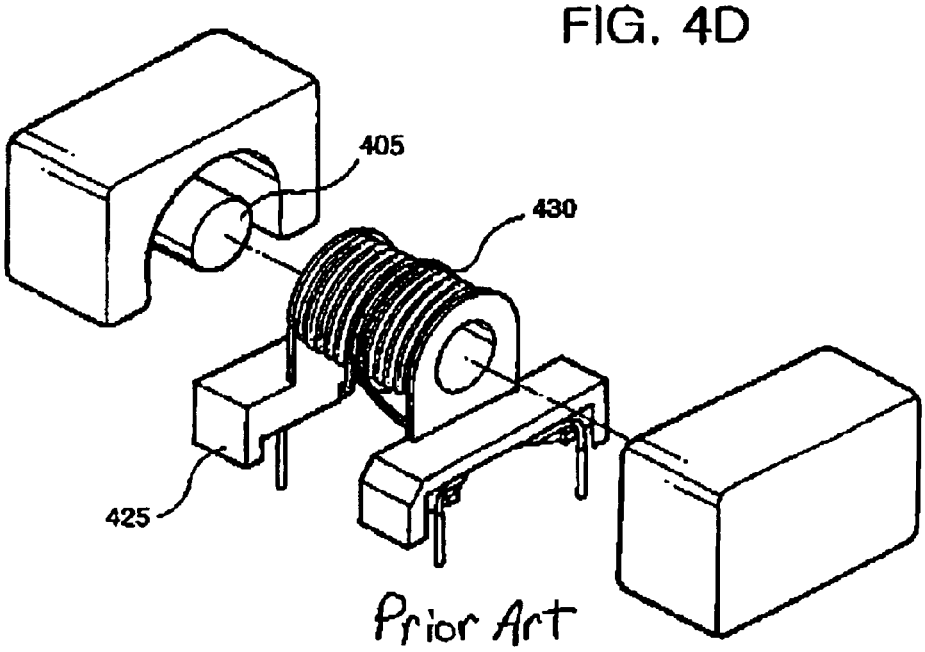
FIG. 4D shows a bobbin coupled to a conventional EP type magnetic core of FIGS. 4A to 4C.
Figure 4E:
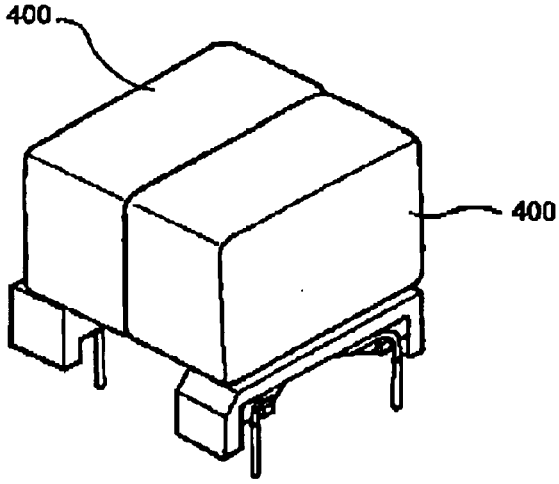
Prior Art FIG. 4E
FIG. 4E is a perspective view of the bobbin of FIG. 4D.

The present invention relates to an EPS type magnetic core for use in an inductor, the EPS type magnetic core modified from a conventional EP type magnetic core. The conventional EP type magnetic core has been developed for communication and signal transmission of a high frequency signal. FIGS. 4A to 4C show the construction of a conventional EP type magnetic core 400, and they are a top plan view, a front view, and a rear view, respectively. A center portion 405 of the magnetic core has a shape of column, and a peripheral portion 410 of the magnetic core encloses the center portion of the magnetic core. The center portion is connected to the peripheral portion by a bottom portion 415. The peripheral portion 410 and the bottom portion 415 shields magnetic flux generated from the inductor. The peripheral portion is removed from a front portion of the magnetic core, and the front portion will now be referred as an opening portion 420, hereinafter. The peripheral portion 410 is shaped in such a manner that its outer profile has a rectangular shape and its inner profile has a circular shape. Therefore, a thickness of the peripheral portion is not constant, and corners of the peripheral portion are thickened. Two EP type magnetic cores described above are opposed and coupled to each other by a bobbin, thereby forming one inductor. FIG. 4*d* shows a feature of two EP type magnetic cores engaged by a bobbin 425, and FIG. 4*e* shows the resulted inductor. Each center portion 405 of two magnetic cores is inserted into the bobbin wound with a coil 430 to form one inductor, with the peripheral portions of two magnetic cores being abutted against each other. The center portion 405 of the magnetic core is to be substantially wound with the coil by the bobbin 425. The opening portion 420 of the magnetic core is to be contacted with the bobbin 425. The coil 430 is existed in a space defined by the center portion 405, peripheral portion 410 and bottom portion 415 of the magnetic core.

Figure 4F:
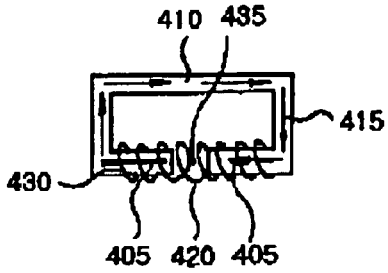
FIG. 4F is a cross sectional view of a conventional inductor.

FIG. 4F is a cross sectional view of the resulted inductor with a bobbin omitted. The center portion of the magnetic core is secondarily ground to a determined depth to form an air gap 435. The magnetic flux generated by the inductor flows along the center portion 405, peripheral portion 410 and bottom portion 415 of the magnetic core, thereby preventing the magnetic flux from being leaked outwardly from the inductor. Generally, the above conventional EP type magnetic core has no the air gap 435. Even though the air gap is provided, a size of the air gap is within a range of a few $\mu$m to several tens $\mu$m. Therefore, the conventional inductor has a characteristic of passage fidelity to a small-signal wavelength with a low current fluctuation. In addition, due to the good magnetic coupling, it has a structure capable of reducing a transmission loss.

However, if a large-current flows along the conventional EP type magnetic core described above, magnetic saturation is easily formed. Therefore, a waveform is not transmitted with good fidelity in an audio amplifier having the wild fluctuation of the current between a saturation region and an unsaturation region. In addition, since a signal of the digital audio amplifier is a large-current signal and a high frequency signal, the inductor has a strong magnetic field exerting a significant influence on a periphery circuit. In the EP type magnetic core, since the bottom portion 415 and peripheral portion 410 of the magnetic core surround the coil in a shape of semicircle, the magnetic flux leaked from the opening portion 420 may exert any influence on other components of the periphery circuit when the high frequency and high current signal flows along the magnetic core.

Specifically, the conventional EP type magnetic core is extended toward the opening portion 420 to an extent of about 40 to 45 percentages of a length, r, from a center of the center portion to an internal surface of the peripheral portion, as shown in FIG. 4A. Accordingly, as will be seen from FIG. 4F, according to the conventional EP type magnetic core, a portion of the coil is outwardly exposed from the opening portion 420 in which the peripheral portion and bottom portion are not existed, thereby resulting in a problem of shielding the magnetic flux.

The EPS type magnetic core of the present invention is characterized in that an air gap is enlarged to some extent of allowing a large signal to be passed, without being easily saturated in a large-current signal and a high frequency signal, and that a bottom portion and peripheral portion of the magnetic core are extended toward an opening portion to properly shield a magnetic field. The air gap of the magnetic core for use in an inductor according to the present invention may be easily varied depending upon a magnitude and characteristic of the large signal to be used. The magnetic core for the inductor may be distributed in a primarily ground state, without grinding it secondarily. Accordingly, the present invention will now be described in focus of the extension of the bottom portion and peripheral portion of the magnetic core.

The construction and operation of the EPS type magnetic core according to the present invention will now be described with reference to FIGS. 5A through 5F. FIGS. 5A, 5B, 5C, and 5D are a perspective view, a top plan view, a front view, and a rear view of an EPS type magnetic core according to the present invention, respectively.

An EPS type magnetic core 500 of the present invention is characterized in that a bottom portion 515 and a peripheral portion 510 is extended toward an opening portion 520 to a length l, which is about 70 percentages of a length r from the center of the center portion to an internal surface of the peripheral portion being opposite to the opening portion. The present inventor found that if the bottom portion 515 and the peripheral portion 510 are extended to the length l, the shield of the magnetic flux in the large signal and high frequency signal is effectively achieved. For the convenience of the explanation, on the basis of the center of the center portion of the magnetic core, the extended portion is referred as a front portion 540, and the portion being opposite to the opening portion is referred as a rear portion 550. Accordingly, the bottom and peripheral portions of the front portion are designated as front bottom portions 540 and 515 and front peripheral portions 540 and 510, respectively, while the bottom and peripheral portions of the rear portion are designated as rear bottom portions 550 and 510 and rear peripheral portions 550 and 510, respectively. In order to prevent the magnetic flux from being leaked from the coil in the conventional EP type magnetic core, the more the bottom and peripheral portions of the magnetic core are extended toward the opening portion, the more remarkable the shielding effect is. Therefore, the present inventor thought that if the length l is made to be equal to the length r, the shielding effect could be considerably achieved.

Furthermore, the present inventor found that when the coil 530 is wound around the bobbin, the coil cannot be wound in more close to the internal surface of the peripheral portion due to the thickness of the coil 530, in other words, the wound coil 530 does not occupy the whole of the length r. Specifically, in the conventional magnetic core, it is found that a case that the length r' wound by the coil 530 is below 70 percentages of the length r was rarely, and cases of 74 percentages and 80 percentages were common. Accordingly, the magnetic core according to the present invention is designed to have the length l as short as possible, while maintaining the effect of shielding the magnetic flux. With the construction of the present invention, the effects of miniaturizing the magnetic core and saving magnetic material may be achieved, while shielding the leaked magnetic flux. In addition, it can prevent the deterioration of the performance of coil winding operation in accordance with the increasing height of the used bobbin.

Meanwhile, the present invention provides the structure of the magnetic core suitable for effectively performing secondarily grinding operation of grinding the center portion of the magnetic core to a predetermined depth to form the air gap, and a grinding method thereof. Referring to FIGS. 5*a* to 5*d*, the EPS type magnetic core is characterized in that a recess 512 is provided in the rear peripheral portion. The recess 512 is provided by a molding to be molded and sintered together with other components, for example, the center portion 505, peripheral portion 510, and bottom portion 515 of the magnetic core. Since the peripheral portion 510 having the recess 512 has a height lower than that of the adjacent peripheral portion 510, a surface of the recess is not ground by the primary grind operation. Accordingly, it is considered that the surface of the recess is coarser than that of the peripheral portion ground primarily. A width w and depth d of the recess shown in FIGS. 5*b* and 5*c* are determined in view of a length of the air gap to be formed. In other words, the recess has a depth d deeper than that of the center portion that is removed at the secondary grinding operation, and a width w wider than or equal to a diameter E of the center portion.

Figure 6:
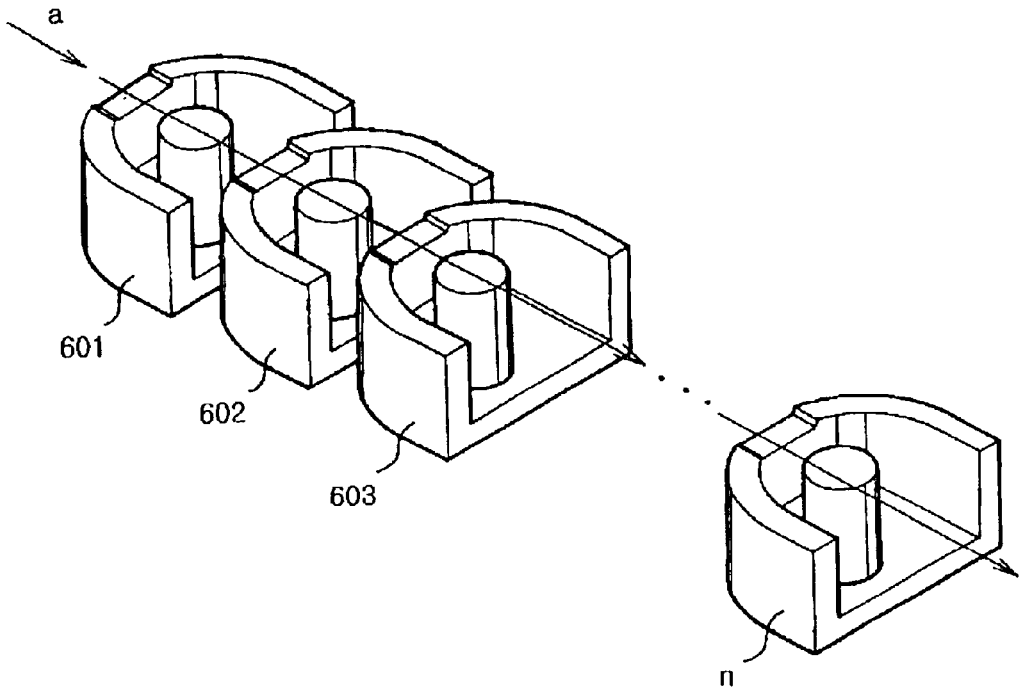
FIG. 6 shows a method of grinding a center portion of a magnetic core according to the present invention.

The grinding operation of the center portion of the EPS type magnetic core having the recess according to the present invention is performed by a method shown in FIG. 6. After aligning a plurality of the EPS type magnetic cores of the present invention along a line linking the recess, center portion and opening portion as a base line, a secondary grinder moves to the center portion through the recess in an aligning direction of the magnetic cores, so that it can continuously grind the center portion from the first EPS type magnetic core 601 to the $n^{th}$ EPS type magnetic core. Since the width of the recess is wider than the diameter of the center portion and the depth is deeper than that of the center portion to be ground, the secondary grinder can move continuously at one time, without being subjected to any restriction. With the process, the productivity of forming the air gap of the magnetic cores is increased remarkably.

It will now be described that the influence of the recess 512 exerting on the shield against the leaked magnetic flux has no a specially considerable value with reference to FIGS. 5E and 5F. FIGS. 5E and 5F are a perspective view and a cross sectional view of the inductor with the bobbin 525 coupled to the EPS type magnetic core according to the present invention, respectively. Referring to FIG. 5F, when the magnetic flux flows in the direction indicated by "a" in a magnetic path, the magnetic flux has to pass an air gap 535. When the magnetic flux flows in the direction indicated by "b", since there are some magnetic paths other than the recess 512, it has no influence on the shield of the leaked magnetic flux. It would be understood to one skilled in the art that the width and height of the recess of the present invention is not increased indefinitely, but is limited to a range which is not affected by the leaked magnetic flux.

Figure 7:
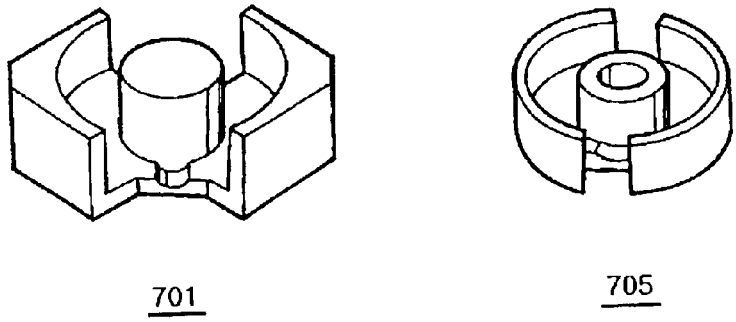
FIG. 7 is a perspective view of comparative embodiments of the present invention, in which one is related to an RM type magnetic core, and the other is related to a POT type magnetic core.

As shown in FIG. 7, although an RM magnetic core 701 and a POT magnetic core 705 among conventional magnetic core for use in the inductor for communication have a recess, it is intended to lead out a cable and radiate heat, and a shape thereof is different from that of the recess according to the present invention. In addition, when the center portion of the magnetic cores is secondarily ground, the magnetic cores each having no a recess may be aligned in series and secondarily ground in succession. However, since the peripheral portion of the magnetic core has to be ground together with the center portion, an unnecessary load is applied to the grinder. Since the operation of forming of the air gap is to precisely grind ferrite ceramics, it requires a considerable time and has a lot of losses due to the rupture of the ceramic. Therefore, it is necessary to limit a speed of the grinder, thereby preventing the thin peripheral portion of the magnetic core from being damaged.

Figure 5A:
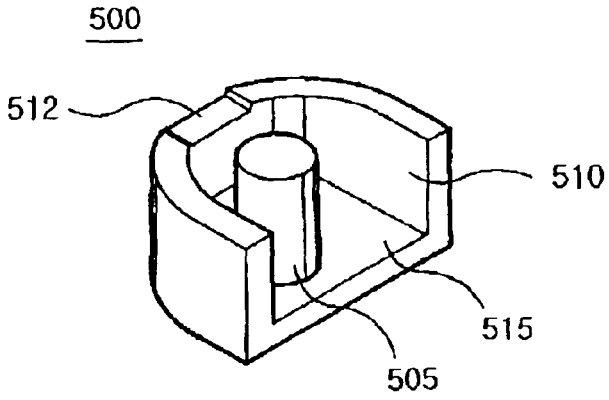
FIG. 5A is a perspective view of an EPS type magnetic core according to the present invention.
Figure 5B:
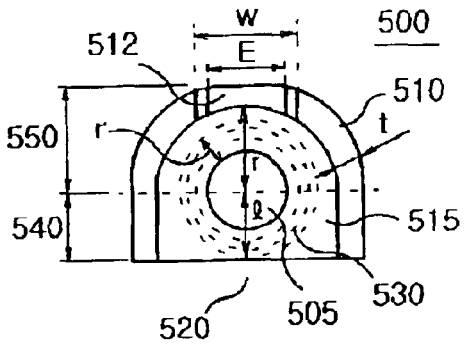
FIGS. 5B, 5C and 5D are a top plan view, a front view, and a rear view of the magnetic core in FIG. 5A, respectively.
Figure 5C:
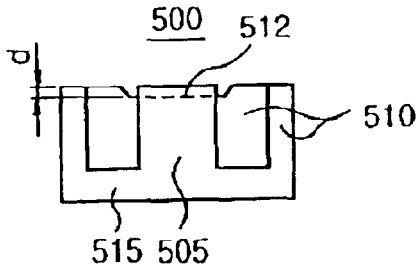
Figure 5D:
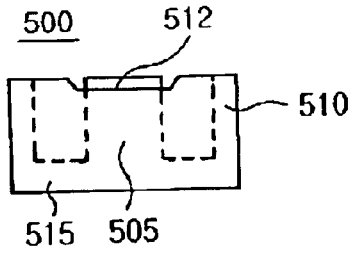
Figure 5E:
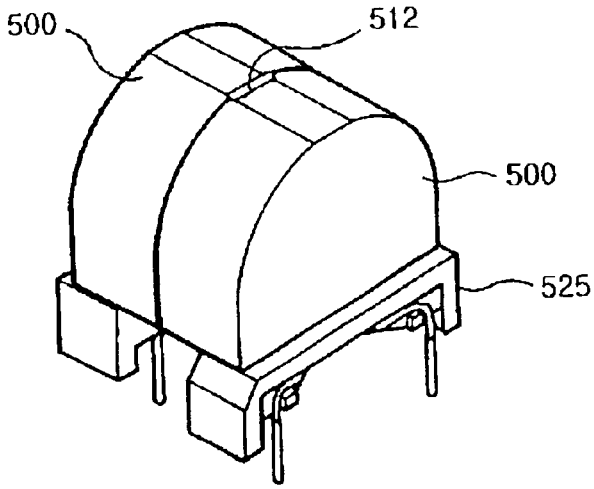
FIG. 5E is a perspective view of the inductor with a bobbin coupled to an EPS type magnetic core according to the present invention.
Figure 5F:
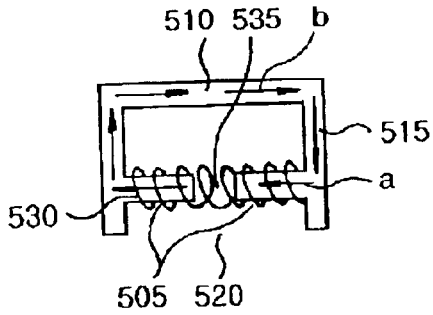
FIG. 5F is a cross sectional view of the inductor in FIG. 5E.

Another feature of the EPS type magnetic core according to present invention is that the peripheral portion 510 of the magnetic core has a uniform thickness t, as shown in FIGS. 5*a* and 5*b*, and particularly, the thickness of the rear peripheral portions 550 and 510 is constant relative to the conventional EP type magnetic core. Specifically, outer and inner profiles of the peripheral portion 510 of the present invention are identical to each other, thereby reducing an amount of unnecessary expensive magnetic material. The outer and inner profiles of the peripheral portion 510 may be a quadrangle or circle, but the circle is more preferable, in view of a defective proportion of the magnetic core. In case of providing the peripheral portion of the magnetic core with the circle, it is more preferable to flat at least a part of the peripheral portion of the magnetic core, in view of convenience when mounting it onto a PCB using a robot. In other words, as shown in FIG. 5*b*, both of the front peripheral portions 540 and 510 each extended toward the opening portion are formed in a straight line in parallel to each other, so that both the extended portions are easily gripped by the robot. Alternatively, the rear peripheral portions 550 and 510 being opposite to the opening portion are formed to be a flat surface, so that the flat surface may be easily gripped by vacuum suction of the robot. In order to prevent distortion or bend of the magnetic core having the peripheral portion with a constant thickness t, it is necessary to apply uniformly pressure on a mold when shaping a magnetic body of powder.

Figure 8A:
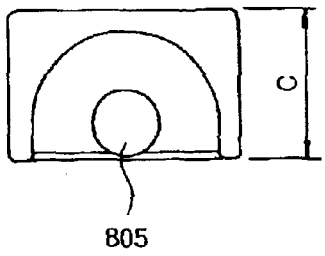
FIG. 8A is a top plan view of an EP type magnetic core according to an comparative embodiment of the present invention.
Figure 8B:
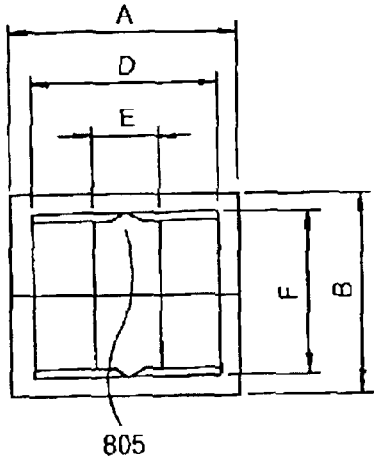
FIG. 8B is a bottom view illustrating a state in which a pair of the EP type magnetic cores are coupled to each other.
Figure 9A:
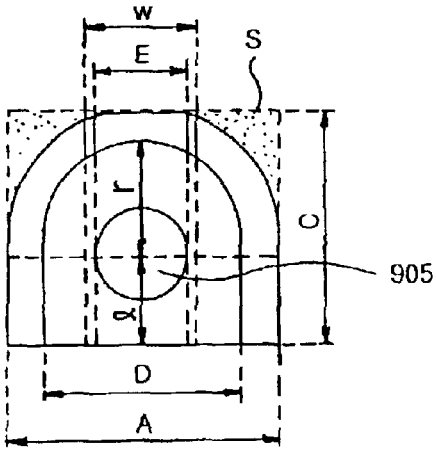
FIG. 9A is a top plan view of an EPS type magnetic core according to one embodiment of the present invention.
Figure 9B:
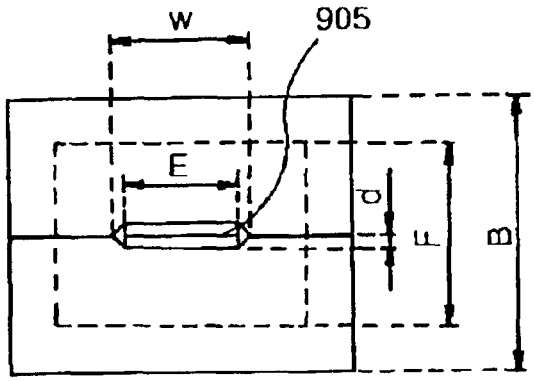
FIG. 9B is a top plan view illustrating a state in which a pair of the EPS type magnetic cores are coupled to each other.

An EPS type magnetic core according to another preferred embodiment of the present invention will now be described in detail with reference to FIGS. 9A and 9B. FIG. 9A is a top plan view of the EPS type magnetic core, and FIG. 9*b* is a view illustrating a state in which two EPS type magnetic cores are coupled to each other, and a top plan view of FIG. 5E. FIGS. 8A and 8B are to describe a comparative embodiment. FIG. 8A is a top plan view of an EP type magnetic core, and FIG. 8B is a view illustrating a state in which two EP type magnetic cores are coupled to each other, and a bottom view of FIG. 4E. FIGS. 8B and 9B show a state prior to forming an air gap in center portions 805 and 905 of the magnetic core, respectively.

Particular parts of the magnetic core are designated by reference characters, i.e., dimension, in FIGS. 9A and 9B. As shown in FIGS. 8A and 8B, reference characters A to F are symbol to indicate dimension of the conventional EP type magnetic core, and the parts of the EPS type magnetic core of the present invention corresponding to that of the conventional EP type magnetic core are designated by same characters in FIGS. 9A and 9B. In addition, reference characters w, d, l and r designate a width of an upper portion of the recess, a depth of the recess, a length of the front peripheral portion and the front bottom portion, and an internal diameter of the rear peripheral portion, respectively, a unit of each dimension being millimeter.

Dimensions of the principal part of an EPS type magnetic core '13' according to the first embodiment of the present invention (EPS 13), an EPS type magnetic core '17' according to the second embodiment (EPS 17), an EP type magnetic core '13' according to the first comparative embodiment (EP 13), and an EP type magnetic core '17' according to the second comparative embodiment (EP 17) are described in a below Table 1:

TABLE 1

| | w | d | l | r | A | B | C | D | E | F | G |
|---|---|---|---|---|---|---|---|---|---|---|---|
| Embodiment 1 EPS 13 | 6.30 | 1.50 | 3.70 | 5.00 | 12.20 | 12.20 | 9.40 | 10.00 | 4.35 | 9.20 | 3.8 |
| Comparative Embodiment 1 EP 13 | — | — | — | — | 12.50 | 12.85 | 8.80 | 10.00 | 4.35 | 9.20 | 5.1 |
| Embodiment 2 EPS 17 | 7.70 | 1.50 | 4.84 | 6.00 | 15.00 | 15.20 | 11.84 | 12.00 | 5.68 | 11.50 | 6.4 |
| Comparative Embodiment 2 EP 17 | — | — | — | — | 18.00 | 16.80 | 11.00 | 12.00 | 5.68 | 11.30 | 12.0 |

EPS 13

A rear peripheral portion of the EPS 13 has an inner diameter r of 5 mm, and a front peripheral portion and a front bottom portion have a length l of 3.7 mm, which is a value corresponding to about 74 percentages of the inner diameter of the rear peripheral portion. A width w of an upper portion of a recess located on the rear peripheral portion is 6.30 mm, which is longer than a diameter E, 4.35 mm, of a center portion. A thickness of the peripheral portion determined by (A-D)/2 is 1.1 mm and is uniform all over. A thickness of the peripheral portion around the recess is 0.7 mm, which is slightly thinner than that of other peripheral portion. It is the reason a flat portion is formed to facilitate a mounting process of PCB. By the same reason, the front peripheral portions are formed in a straight line in parallel to each other.

EPS 17

A rear peripheral portion of the EPS 17 has an inner diameter r of 6 mm, and a front peripheral portion and a front bottom portion have a length l of 4.84 mm, which is a value corresponding to about 80 percentages of the inner diameter of the rear peripheral portion. A width w of an upper part of a recess located on the rear peripheral portion is 7.70 mm, which is longer than a diameter E, 5.68 mm, of a center portion. However, a thickness of the peripheral portion determined by (A-D)/2 is 1.5 mm and is uniform all over. A thickness of the peripheral portion around the recess is 1.04 mm, which is slightly thinner than that of other peripheral portion. It is the reason a flat portion is formed to facilitate a mounting process of PCB. By the same reason, the front peripheral portions are formed in a straight line in parallel to each other.

It is confirmed that a depth of the recess in the EPS 13 and EPS 17 is 1.5 mm. An air gap is formed by the gap between the center portions of two coupled magnetic cores that are secondarily ground. It is expected that a magnetic gap formed in case of the EPS 13 and EPS 17 is below than 3 mm. The present embodiment employs the air gap of about 0.5 mm in the inductor for a digital audio amplifier.

A portion indicated by a reference character 'S' in FIG. 9A is shown to describe a characteristic of the present invention which the thickness of the peripheral portion is uniform. If a recess is provided in the peripheral portion or the peripheral portion and the bottom portion are extended toward the opening portion, the magnetic core is included the scope of this invention regardless of the thickness of the peripheral portion. Further, as shown in FIG. 9A, if a corner of the peripheral portion indicated by 'S' is removed, one feature of the present invention may be achieved to reduce an amount of magnetic material. The reduced amount can be easily calculated according to a formula S×(a height of the peripheral portion)×(a density of the magnetic material).

Such a feature of the present invention may be again confirmed through the comparative embodiment described in Table 1. In Table 1, a parameter G represents a weight of the magnetic core, and a unit is gram. The weight of the EPS 13 is 75 percentages (=3.8/5.1) of a weight of the EP 13, to indicate weight reduction of 25 percentages. The weight of the EPS 17 is 53 percentages (=6.4/12.0) of a weight of the EP 17, to indicate weight reduction of 47 percentages.

The reason that the weight of the EPS type magnetic core of the present embodiments is reduced than that of the EP type magnetic core of the comparative embodiments is resulted from the reduced thickness of the peripheral portion and the bottom portion. However, considering that the peripheral portion and the bottom portion of the magnetic core according to the present embodiment are extended more than those of the comparative embodiment, it would be understood that the effect of the reduced weight is related to the feature of the present invention. The dimensions D, E and F of the present embodiment, which are indicative of a size of an interior space, are equal to those of the comparative embodiment as shown in table 1. Nevertheless, the leakage of the magnetic flux is effectively shielded more than the comparative embodiments by the peripheral portion and the bottom portion which are more extended toward the opening portion. In addition, the weight of the magnetic core according to the present embodiments is less than that of the magnetic core according to the comparative embodiments.

Alternative Embodiments

Figure 10A:
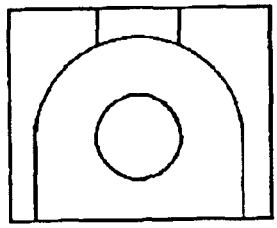
FIGS. 10A to 10F are top plan view or rear view of alternative embodiments of the present invention.
Figure 10B:
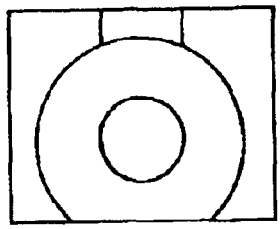
Figure 10C:
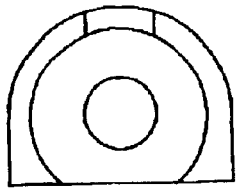
Figure 10D:
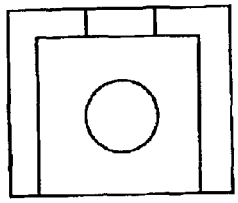
Figure 10E:
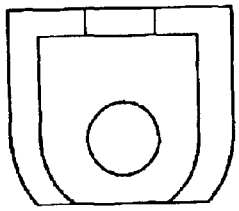
Figure 10F:
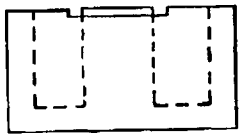

Numerous embodiments may be devised by those skilled in the art without departing from the scope of the following claims. For example, the extended shape of the bottom portion and the bottom portion, the shape of the peripheral portion having a constant thickness, and the shape of the recess may be modified. FIGS. 10*a* to 10*e* shows various shapes of the peripheral portion, and FIG. 10*f* show various shapes of the recess.

In addition, the recess according to the present invention may be provided for by the conventional EP type magnetic core. In case of the magnetic core having no the opening portion like the conventional EP type magnetic core, the recess may be provided in both side of the peripheral portion.

Further, the EPS type magnetic core of the present invention is devised for the large-signal, but the same effect may be achieved by applying it to the small-signal.

The magnetic core of the present invention may be distributed in a state that the center portion is secondarily ground or not.

The foregoing embodiment is merely exemplary and is not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. An EPS type magnetic core, an improvement of EP type magnetic core, for an inductor, comprising a center portion, a peripheral portion, a bottom portion, and an opening portion:

wherein the bottom portion and the peripheral portion form a partial enclosure for housing the center portion, the center portion being located on the bottom portion, the peripheral portion extending partially around the center portion to form two generally straight end segments with an arcuate segment therebetween, the arcuate segment extending about approximately half of the center portion and being spaced a predetermined distance from a center of the center portion, the two generally straight end segments, in combination with the bottom portion define the opening portion, a distance from the center of the center portion to the opening portion being about seventy percent of the predetermined distance.

2. The EPS type magnetic core as claimed in claim 1, wherein the peripheral portion opposite to the opening portion has a uniform thickness.

3. The EPS type magnetic core as claimed in claim 2, wherein the thickness of the peripheral portion is constant all over, the peripheral portion being extended toward the opening portion is in a straight line in parallel to each other, and the peripheral portion opposite to the opening portion has a semicircular shape.

4. The EPS type magnetic core as claimed in claim 3, wherein the peripheral portion directly opposite to the opening portion has a flat surface formed on an outer circumference thereof.

5. The EPS type magnetic core as claimed in claim 1, wherein the center portion is ground to a predetermined depth to form an air gap, such that the EPS type magnetic core is used for a large-current signal and a high-frequency signal.

6. The EPS type magnetic core as claimed in claim 5, wherein the EPS type magnetic core is used for a digital audio amplifier.

7. The EPS type magnetic core as claimed in claim 1, further comprising a recess formed in a predetermined position of the peripheral portion, wherein the position in which the recess is located is opposite to the opening portion, and the recess has a width more than or equal to a diameter of the center portion, and a depth more than a depth of the center portion being ground.

8. The EPS type magnetic core as claimed in claim 7, wherein the recess is formed in the peripheral portion which is integrally formed with the center portion and the bottom portion.

9. The EPS type magnetic core as claimed in claim 7, wherein the EPS type magnetic core is used for a digital audio amplifier.

10. A magnetic core for an inductor, having a center portion, a peripheral portion, and a bottom portion, two magnetic cores being opposite and coupled to each other to form one inductor, the center portion being wound by a coil when forming the inductor, being ground to form an air gap, and forming a magnetic path through which magnetic flux generated during operation of the inductor flows, the peripheral portion surrounding the center portion, the bottom portion which couples the center portion to the peripheral portion forming the magnetic path to prevent the magnetic flux from leaking out of the inductor, and the coil being inserted into a space defined by the center portion, the peripheral portion, and the bottom portion, the magnetic core comprising:

at least one recess located in an edge of the peripheral portion having a width larger than or equal to a diameter of the center portion and a an edge closer to the bottom portion than a top of the center portion being ground to facilitate grinding of the center portion, and integrally formed with the center portion, bottom portion and peripheral portion.

11. A magnetic core for an inductor, the magnetic core having a center portion, a peripheral portion, a bottom portion, and an opening portion, two magnetic cores being opposite and coupled to each other to form one inductor, the center portion being wound by a coil when forming the inductor, being ground to form an air gap, and forming a magnetic path through which magnetic flux generated during operation of the inductor flows, the peripheral portion surrounding the center portion, the bottom portion which couples the center portion to the peripheral portion forming the magnetic path to prevent the magnetic flux from leaking out of the inductor, the coil being inserted into a space defined by the center portion, the peripheral portion, and the bottom portion, and the opening portion being a portion from which the peripheral portion is removed, the magnetic core comprising:

a recess located in an edge of the peripheral portion opposite to the opening portion, the recess having a width larger than or equal to a diameter of the center portion and having an edge closer to the bottom portion than a top of the center portion being ground, and integrally formed with the center portion, bottom portion and peripheral portion.

12. The magnetic core as claimed in claim 11, wherein the magnetic core comprises an EP type magnetic core.

13. The magnetic core as claimed in claim 10, wherein the center portion is ground.

* * * * *